US009409748B2

(12) United States Patent
Mizuno et al.

(10) Patent No.: US 9,409,748 B2
(45) Date of Patent: Aug. 9, 2016

(54) ELEVATOR SAFETY DEVICE AND ELEVATOR SAFETY DEVICE MOUNTING METHOD

(75) Inventors: Sachiomi Mizuno, Tokyo (JP); Hideki Nakamura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 276 days.

(21) Appl. No.: 14/126,695

(22) PCT Filed: Sep. 7, 2011

(86) PCT No.: PCT/JP2011/070391
§ 371 (c)(1),
(2), (4) Date: Dec. 16, 2013

(87) PCT Pub. No.: WO2013/035175
PCT Pub. Date: Mar. 14, 2013

(65) Prior Publication Data
US 2014/0151159 A1 Jun. 5, 2014

(51) Int. Cl.
*B66B 5/18* (2006.01)
*B66B 5/22* (2006.01)

(52) U.S. Cl.
CPC .... *B66B 5/18* (2013.01); *B66B 5/22* (2013.01)

(58) Field of Classification Search
CPC ..... B66B 5/18; B66B 5/16; B66B 5/22
USPC ..... 187/359, 356
See application file for complete search history.

(56) References Cited

U.S. PATENT DOCUMENTS 1,936,780 A * 11/1933 Arnold ..... B66B 5/18 187/375
4,538,706 A * 9/1985 Koppensteiner ..... B66B 5/22 187/376
5,301,773 A * 4/1994 Jamieson ..... B66B 5/22 187/376

FOREIGN PATENT DOCUMENTS

GB 1111425 A * 4/1968 ..... B66B 5/18
JP 53 96763 8/1978
JP 55 78669 5/1980

(Continued)
OTHER PUBLICATIONS

International Search Report Issued May 1, 2012 in PCT/JP11/070391 Filed Sep. 7, 2011.

*Primary Examiner* — William E Dondero
*Assistant Examiner* — Diem Tran
(74) *Attorney, Agent, or Firm* — Oblon, McClelland, Maier & Neustadt, L.L.P

(57) ABSTRACT

A safety supporting body includes: a supporting body main body that is disposed inside a vertical stanchion groove of a car frame; and an engaging portion that protrudes outward from the supporting body main body, and that is hooked onto an upper end portion of a vertical stanchion. The safety supporting body is fixed to the vertical stanchion by a supporting body fixing apparatus. The supporting body fixing apparatus includes: a first fixing bolt that applies pressure between a side surface of the vertical stanchion groove and the supporting body main body; and a second fixing bolt that applies pressure between the engaging portion and a guiding apparatus mounting base that is fixed to the car frame. A safety device main body that applies a braking force to the car by placing a braking member in contact with the guide rail is disposed on the safety supporting body.

7 Claims, 12 Drawing Sheets

(56) References Cited

FOREIGN PATENT DOCUMENTS

| | | |
|---|---|---|
| JP | 57 11172 | 1/1982 |
| JP | 02 295873 | 12/1990 |
| JP | 2001 080840 | 3/2001 |
| JP | 2002 087727 | 3/2002 |
| JP | 2008 162767 | 7/2008 |
| JP | 2009 220898 | 10/2009 |

* cited by examiner

ELEVATOR SAFETY DEVICE AND ELEVATOR SAFETY DEVICE MOUNTING METHOD

TECHNICAL FIELD

The present invention relates to an elevator safety device that is mounted onto a car to apply a braking force to the car, and to an elevator safety device mounting method for mounting the safety device onto the car.

BACKGROUND ART

Conventionally, in order to make safety devices mountable to cars even if the mounting methods differ, elevator safety devices have been proposed in which the safety devices are mounted onto lower beams of cars by means of mounting adapters (Patent Literature 1 and 2).

CITATION LIST

Patent Literature

[Patent Literature 1]
Japanese Patent Laid-Open No. 2008-162767 (Gazette)
[Patent Literature 2]
Japanese Patent Laid-Open No. 2009-220898 (Gazette)

SUMMARY OF THE INVENTION

Problem to be Solved by the Invention

In hydraulic direct-coupled plunger-type elevators (elevators in which a car is coupled directly to a hydraulic plunger, and the car moves vertically by vertical movement of the plunger), for example, sometimes safety devices are not mounted to the car. Consequently, when hydraulic direct-coupled plunger-type elevators are remodeled into suspension elevators in which a car is suspended by ropes or belts, for example, it is necessary to mount safety devices onto the car.

However, when mounting the safety devices that are shown in Patent Literature 1 and 2 onto a hydraulic direct-coupled plunger-type elevator car, because bolt apertures, etc., for mounting the mounting adapter are not disposed on the lower beam of the car, the lower beam, etc., of the car must be transported to a factory to perform machining such as drilling, etc., making the work of mounting the safety devices onto the car very time-consuming. Because of that, the duration of the remodeling work is lengthened, prolonging down time during which the elevator cannot be used.

Because the safety devices that are shown in Patent Literature 1 and 2 are mounted onto the lower beam of the car by means of mounting adapters, the safety devices protrude downward from the car significantly, and if there are not sufficient room in the pit of the hoistway, the safety devices cannot be mounted onto the car.

The present invention aims to solve the above problems and an object of the present invention is to provide an elevator safety device that can be prevented from protruding significantly vertically from a car, and that can be easily mounted onto the car, and to provide an elevator safety device mounting method.

Means for Solving the Problem

In order to achieve the above object, according to one aspect of the present invention, there is provided an elevator safety device that is mounted onto a car that includes a cage and a car frame that surrounds the cage, the car being moved along a guide rail and the elevator safety device applying a braking force to the car, wherein the elevator safety device includes: a safety supporting body that includes: a supporting body main body that is disposed inside a vertical stanchion groove that is disposed vertically on a vertical stanchion of the car frame; and an engaging portion that protrudes outward from the supporting body main body, and that is hooked onto an upper end portion of the vertical stanchion; a supporting body fixing apparatus that includes: a first fixing bolt that applies pressure between a side surface of the vertical stanchion groove and the supporting body main body; and a second fixing bolt that applies pressure between the engaging portion and a guiding apparatus mounting base that is fixed to the car frame above the safety supporting body, the supporting body fixing apparatus being disposed on the safety supporting body so as to fix the safety supporting body to the vertical stanchion; a safety device main body that includes a braking member that is displaceable relative to the safety supporting body, and that is disposed on the safety supporting body so as to apply a braking force to the car by placing the braking member in contact with the guide rail; a safety mounting apparatus that is mounted onto the car frame; and an actuating apparatus that is supported by the safety mounting apparatus, and that displaces the braking member to activate the safety device main body.

Effects of the Invention

The elevator safety device according to the present invention can be prevented from protruding significantly vertically from a car, and can be easily mounted onto the car.

DESCRIPTION OF EMBODIMENTS

Preferred embodiments of the present invention will now be explained with reference to the drawings.

Embodiment 1

Figure 1:
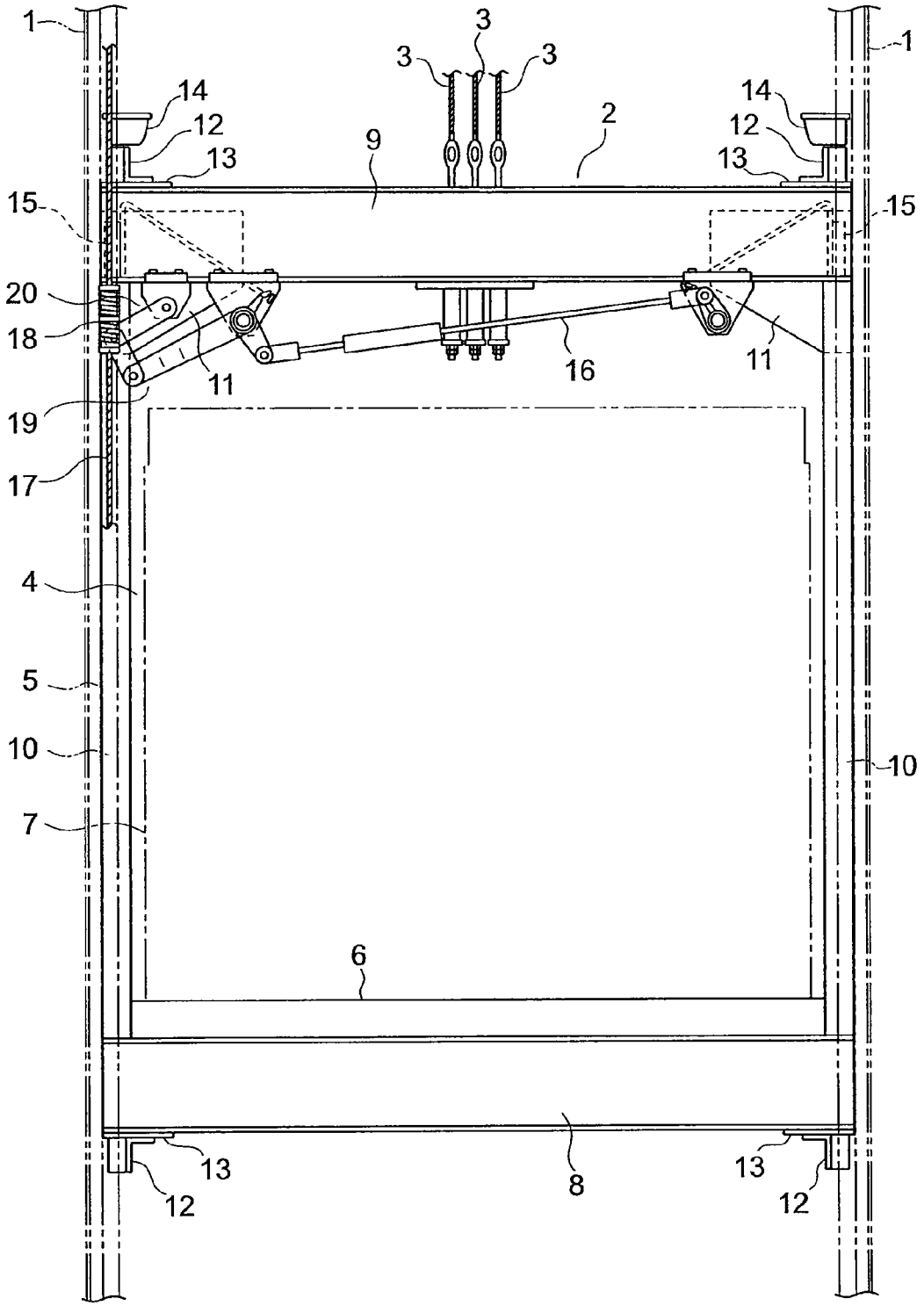
FIG. 1 is a front elevation that shows an elevator car according to Embodiment 1 of the present invention.
Figure 2:
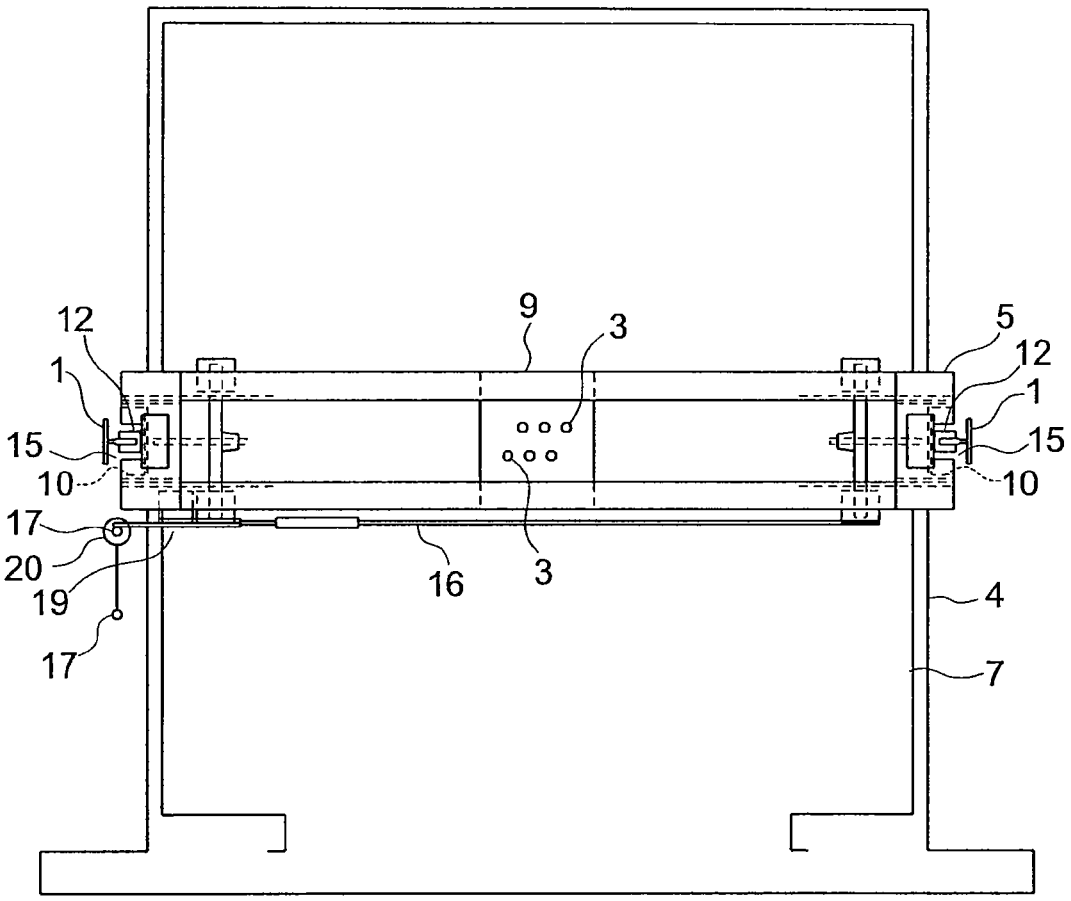
FIG. 2 is a plan that shows the elevator car in FIG. 1.

FIG. 1 is a front elevation that shows an elevator car according to Embodiment 1 of the present invention. FIG. 2 is a plan that shows the elevator car in FIG. 1. In the figures, a pair of guide rails 1 that face each other in a horizontal direction are installed vertically inside a hoistway. A car 2 is disposed between the pair of guide rails 1. The car 2 is suspended inside the hoistway by a plurality of suspending bodies 3. Ropes or belts, for example, are used as the suspending bodies 3. The suspending bodies 3 are wound around a driving sheave of a hoisting machine (not shown) that is a driving apparatus that is disposed inside the hoistway. The car 2 is guided by the guide rails 1 while being moved vertically inside the hoistway by the rotation of the driving sheave of the hoisting machine.

The car 2 has: a cage 4; and a car frame 5 that supports the cage 4, and that surrounds the cage 4. The cage 4 has: a car floor 6; and a cage main body 7 that is mounted onto the car floor 6. The car frame 5 has: a lower frame 8 that is disposed horizontally, on which the cage 4 is mounted; an upper frame 9 that is disposed horizontally above the cage 4; a pair of vertical stanchions 10 that connect respective end portions of the lower frame 8 and the upper frame 9 to each other, and that respectively face the guide rails 1. Gussets 11 that reinforces the car frame 5 are fixed to joined portions between each of the vertical stanchions 10 and the upper frame 9. Each of the suspending bodies 3 is connected to the upper frame 9.

A plurality of guiding apparatuses 12 that guide the car 2 vertically along the guide rails 1 are respectively fixed removably to upper surfaces of two end portions of the upper frame 9 and lower surfaces of two end portions of the lower frame 8 by means of flat guiding apparatus mounting bases 13. Oilers 14 that supply lubricating oil to the guide rails 1 are respectively disposed on each of the guiding apparatuses 12 that are fixed to the upper frame 9.

Mounted onto an upper portion of the car frame 5 are: a pair of safety devices 15 that apply a braking force to the car 2 by gripping the pair of guide rails 1 individually; and a coupling apparatus 16 that operates each of the safety devices 15 together by coupling the pair of safety devices 15 to each other.

A speed governor is disposed in an upper portion of the hoistway, and a tensioning sheave is disposed in a lower portion of the hoistway (neither shown). The speed governor has a speed governor sheave (not shown). A speed governor rope 17 is wound around the speed governor sheave and the tensioning sheave. A first end portion and a second end portion of the speed governor rope 17 are connected to each other by means of a rope connecting apparatus 18.

Connected to the rope connecting apparatus 18 are: a safety linking apparatus 19 that is coupled to the safety devices 15; and a car linking apparatus 20 that is coupled to the car frame 5. Thus, when the car 2 moves vertically, the speed governor rope 17 is moved together with the car 2, and the speed governor sheave is moved in response to the movement of the car 2.

The overspeed switch that is activated when rotational speed of the speed governor sheave reaches a preset set overspeed is disposed on the speed governor. When the overspeed switch is activated, power supply to the hoisting machine that moves the car 2 is stopped, activating the hoisting machine braking apparatus. The speed governor grips the speed governor rope 17 if the rotational speed of the speed governor sheave 15 reaches a safety overspeed that is higher than the set overspeed. Because movement of the speed governor rope 17 is stopped when the speed governor rope 17 is gripped by the speed governor, but movement of the car 2 continues, the car 2 is displaced relative to the speed governor rope 17. The safety linking apparatus 19 is operated by the displacement of the car 2 relative to the speed governor rope 17, activating each of the safety devices 15.

Figure 3:
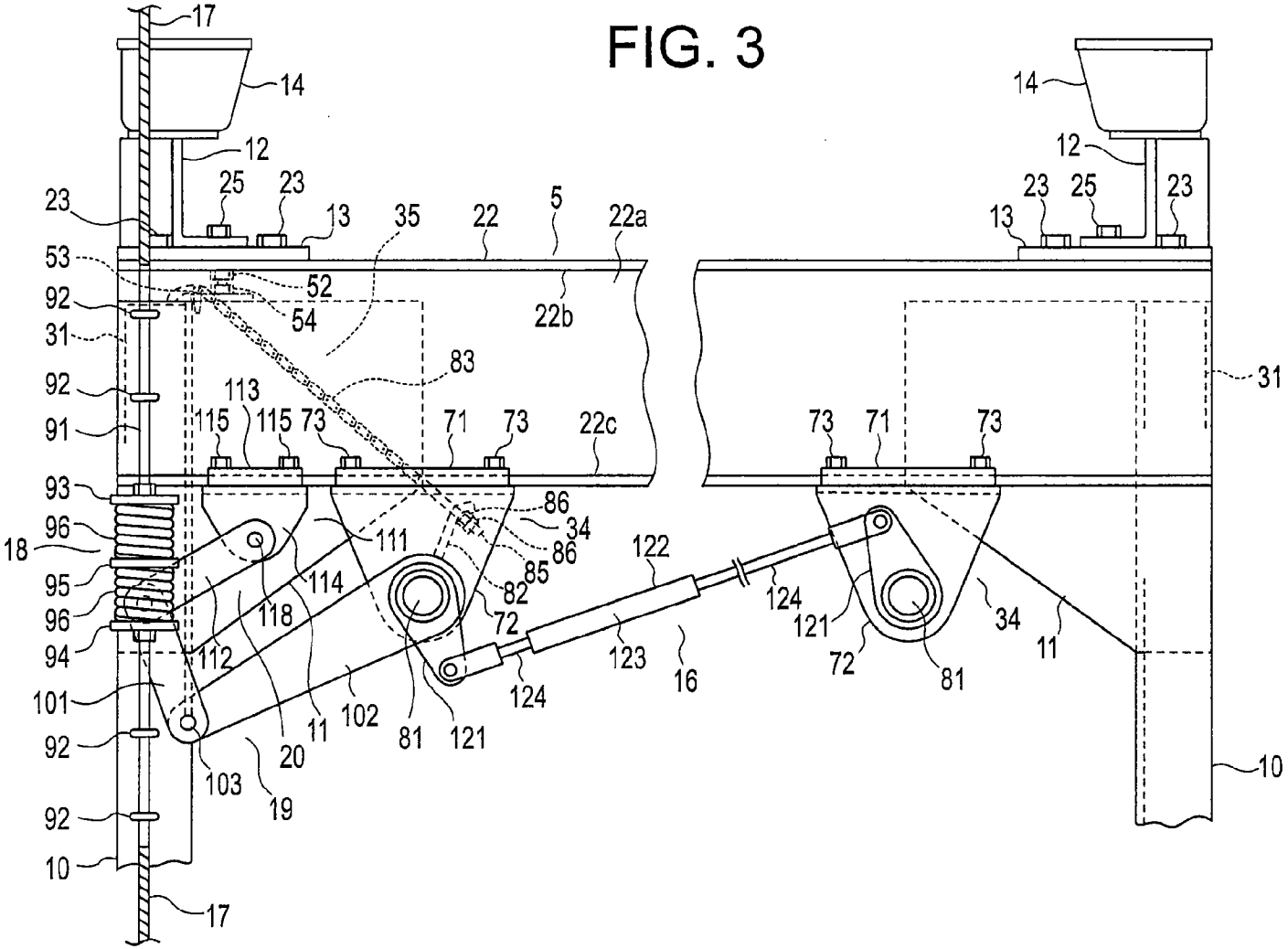
FIG. 3 is a front elevation that shows an upper portion of a car frame from FIG. 1.
Figure 4:
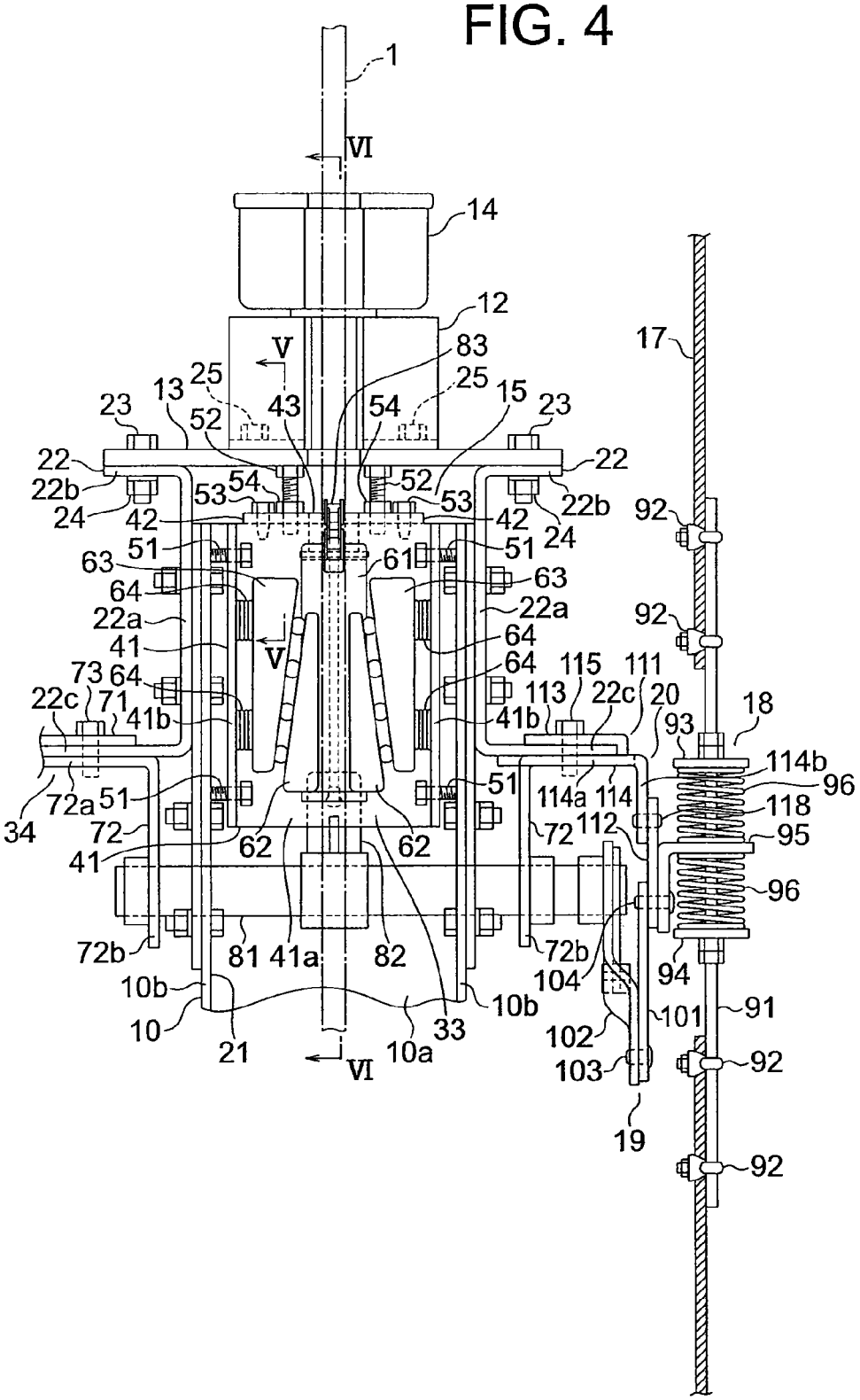
FIG. 4 is a side elevation that shows the car frame in FIG. 3.
Figure 5:
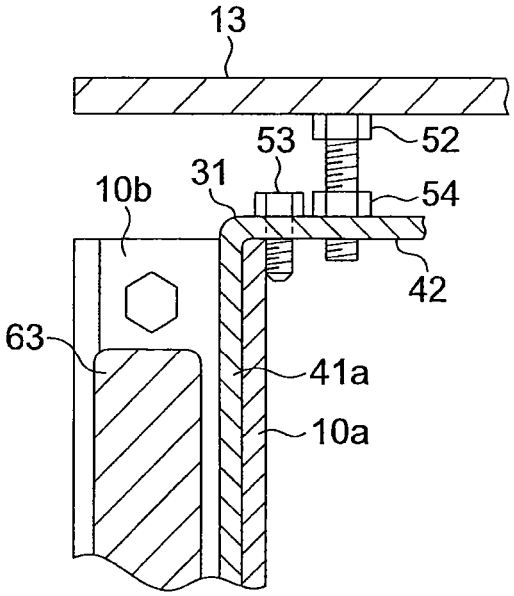
FIG. 5 is a cross section that is taken along Line V-V in FIG. 4.
Figure 6:
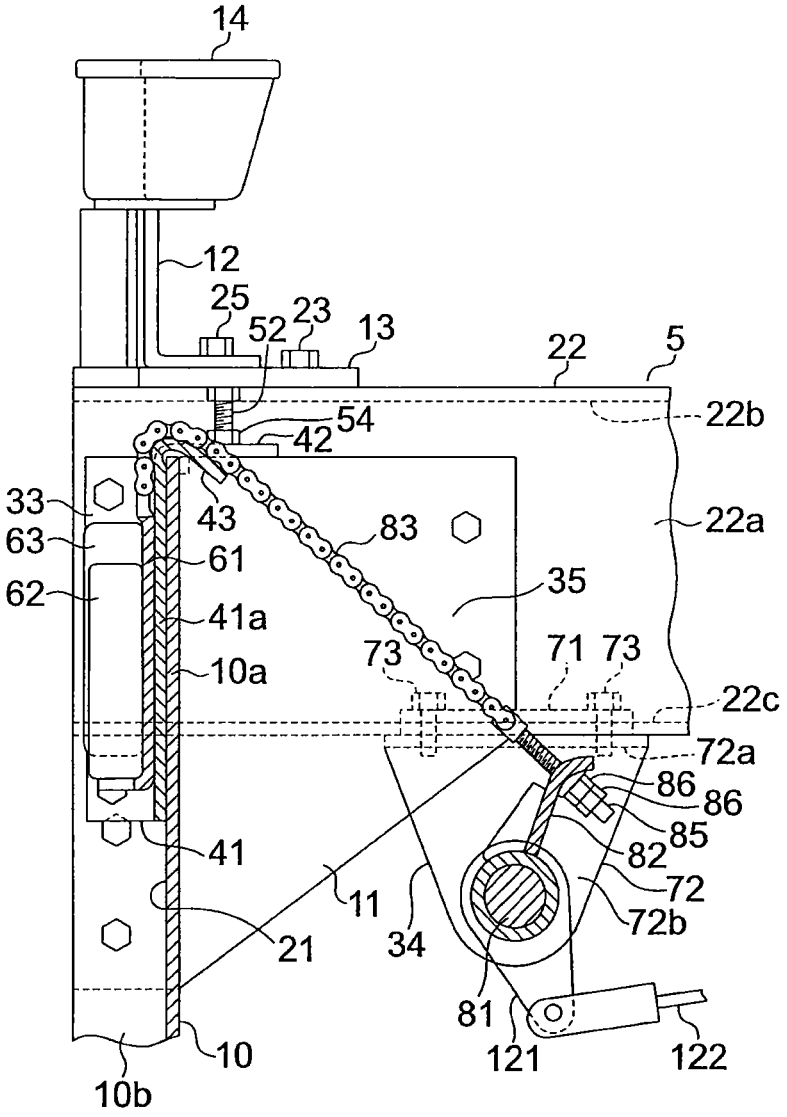
FIG. 6 is a cross section that is taken along Line VI-VI in FIG. 4.
Figure 7:
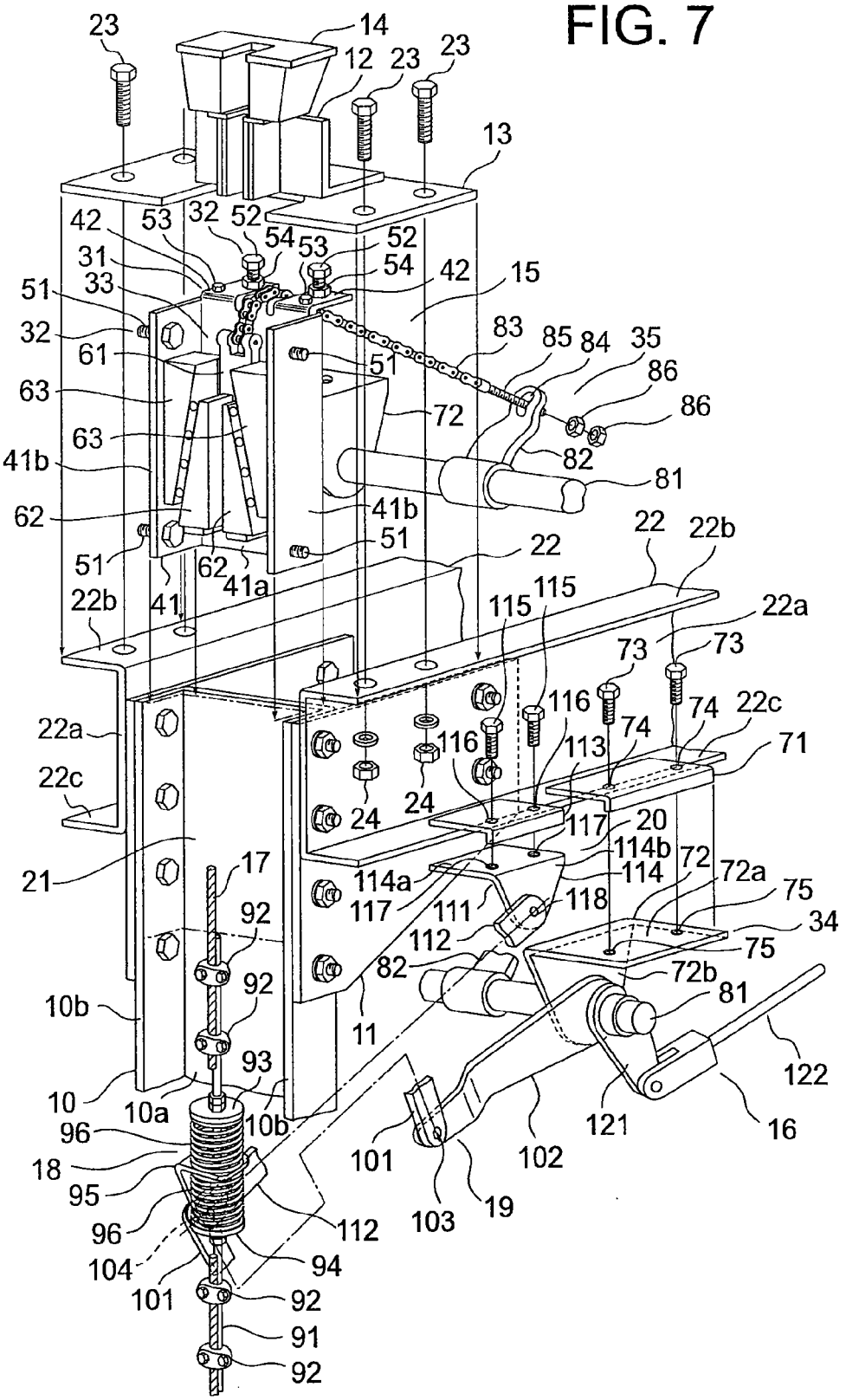
FIG. 7 is an exploded perspective that shows the upper portion of the car frame from FIG. 3.

FIG. 3 is a front elevation that shows an upper portion of the car frame 5 from FIG. 1. FIG. 4 is a side elevation that shows the car frame 5 in FIG. 3. In addition, FIG. 5 is a cross section that is taken along Line V-V in FIG. 4, and FIG. 6 is a cross section that is taken along Line VI-VI in FIG. 4. FIG. 7 is an exploded perspective that shows the upper portion of the car frame 5 from FIG. 3. In the figures, as shown particularly in FIG. 7, each of the vertical stanchions 10 is a prism that has a box-shaped cross section that has: a back plate portion 10*a* that faces a guide rail 1; and a pair of side plate portions 10*b* that protrude toward the guide rail 1 from two side portions of the back plate portion 10*a*. Consequently, a vertical stanchion groove 21 that is open toward the guide rail 1 is formed vertically on each of the vertical stanchions 10 by the back plate portion 10*a* and each of the side plate portions 10*b*.

The upper frame 9 has a pair of upper beams 22 that are on opposite sides of the vertical stanchion 10 in a width direction of the vertical stanchion 10 (the direction in which the pair of side plate portions 10*b* face each other). Each of the upper beams 22 is fixed to the vertical stanchion 10 by nuts and bolts so as to have a gusset 11 interposed. Each of the upper beams 22 is a beam that has a box-shaped cross section that has: a vertical plate portion 22*a*; and an upper plate portion 22*b* and a lower plate portion 22*c* that protrude outward horizontally from an upper edge portion and a lower edge portion, respectively, of the vertical plate portion 22*a* so as to face each other vertically. The pair of upper beams 22 are disposed such that the vertical plate portions 22*a* face each other in the width direction of the vertical stanchion 10 and the upper plate portions 22*b* and the lower plate portions 22*c* face outward.

The guiding apparatus mounting bases 13 are disposed on top of each of the upper beams 22 so as to span between the pair of upper beams 22. The guiding apparatus mounting bases 13 are thereby disposed above the vertical stanchions 10 so as to be separated from the vertical stanchions 10. The guiding apparatus mounting bases 13 are fixed to each of the upper plate portions 22*b* by fastening together a plurality of bolts 23 that are passed sequentially through a plurality of penetrating apertures that are disposed on the guiding apparatus mounting bases 13 and the upper plate portions 22*b*, and a plurality of nuts 24 that are screwed onto each of the bolts 23. The guiding apparatus mounting bases 13 are thereby fixed removably onto the upper frame 9. The guiding apparatuses 12 are fixed to the guiding apparatus mounting bases 13, and the oilers 14 are fixed to the guiding apparatuses 12. Moreover, as shown in FIGS. 3 through 5, the guiding apparatuses 12 are fixed to the guiding apparatus mounting bases 13 by bolts 25.

As shown particularly in FIG. 7, the safety devices 15 have: safety frames (safety supporting bodies) 31 that are supported by upper end portions of the vertical stanchions 10; frame fixing apparatuses (supporting body fixing apparatuses) 32 that are disposed on the safety frames 31, and that fix the safety frames 31 to the vertical stanchions 10; safety device main bodies 33 that are mounted onto the safety frames 31 so as to be able to grip the guide rails 1; safety mounting apparatuses 34 that are mounted onto the upper frame 9; and actuating apparatuses 35 that are supported by the safety mounting apparatuses 34, and that activate the safety device main bodies 33.

Figure 8:
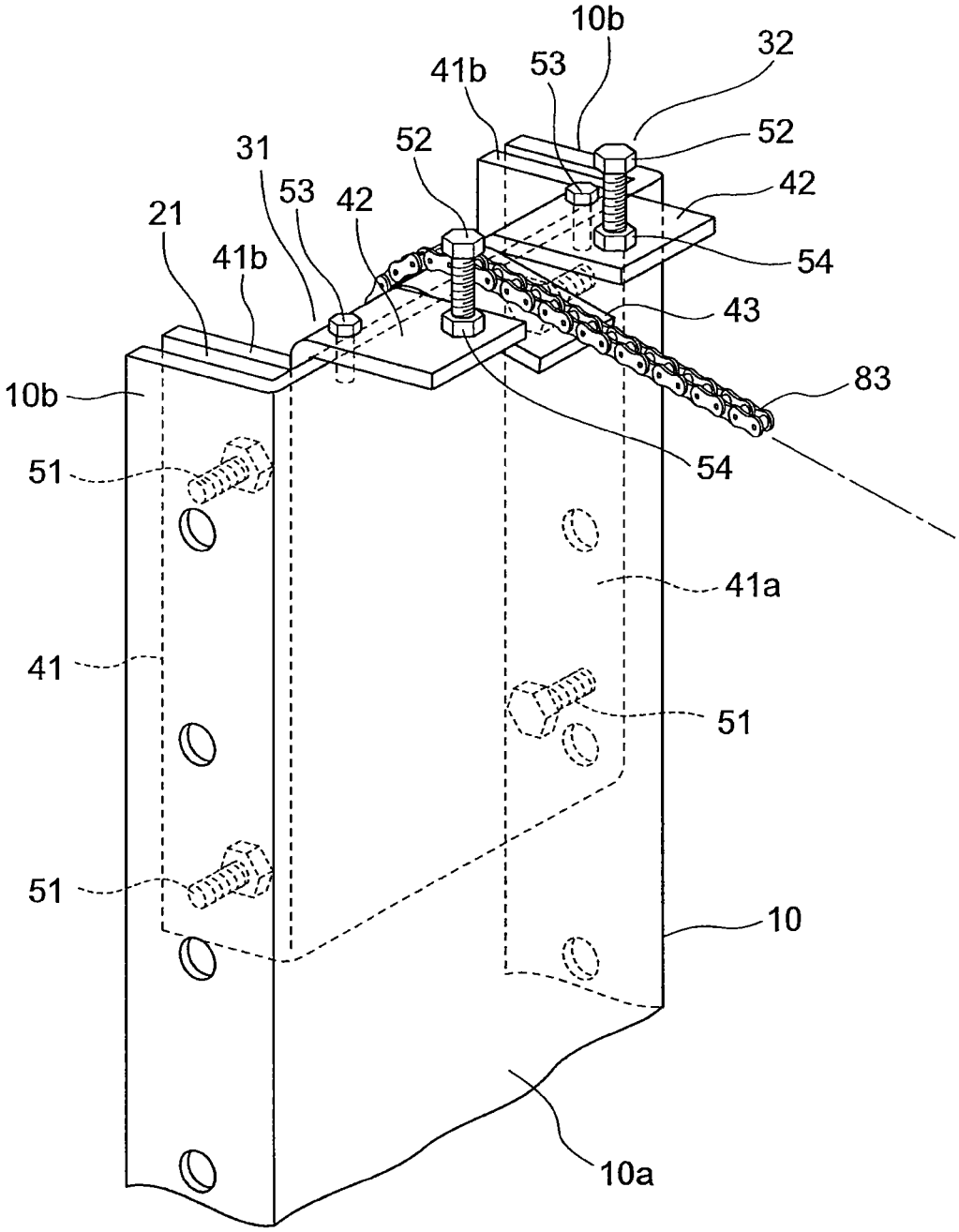
FIG. 8 is a perspective of a safety frame and a vertical stanchion from FIG. 7 when viewed from a different angle.

Now, FIG. 8 is a perspective of the safety frame 31 and the vertical stanchion 10 from FIG. 7 when viewed from a different angle. The safety frame 31 has: a frame main body (a supporting body main body) 41 that is disposed inside the vertical stanchion groove 21; a pair of horizontal plates (engaging portions) 42 that protrude horizontally from an upper end portion of the frame main body 41 so as to hook onto the upper end portion of the vertical stanchions 10; and an inclined plate (a supporting guiding portion) 43 that protrudes from a portion of the upper end portion of the frame main body 41 between the pair of horizontal plates 42 so as to be inclined downward. In this example, the horizontal plates 42 and the inclined plate 43 are formed by bending a portion of the plate that extends from the upper end portion of the frame main body 41.

The frame main body 41 has: a rear plate portion 41*a* that is disposed so as to be parallel to the back plate portion 10*a* of the vertical stanchions 10; and a pair of facing plate portions 41*b* that protrude outward toward the open portion of the vertical stanchion groove 21 from two side portions of the rear plate portion 41*a* so as to face each other in a width direction of the frame main body 41, and a box-shaped cross section is formed by the rear plate portion 41*a* and the respective facing plate portions 41*b*. A width dimension of the frame main body 41 is smaller than a width dimension inside the vertical stanchion groove 21. The horizontal plates 42 and the inclined plate 43 protrude from the upper end portion of the rear plate portion 41*a* in an opposite direction to the facing plate portions 41*b*.

The frame fixing apparatus 32 has: a plurality of horizontal bolts (first fixing bolts) 51 that are screwed into a plurality of screw-threaded apertures that pass through each of the facing plate portions 41*b*; a plurality of jack bolts (second fixing bolts) 52 that are screwed into a plurality of screw-threaded apertures that pass through the horizontal plates 42; and a plurality of restricting bolts 53 that are screwed into a plurality of screw-threaded apertures that pass through the horizontal plates 42 at positions that are closer to the rear plate portion 41*a* than each of the jack bolts 52.

Each of the horizontal bolts 51 protrudes outward from an external surface of the facing plate portions 41*b* in the width direction of the frame main body 41. The amount of protrusion of each of the horizontal bolts 51 from the facing plate portions 41*b* is adjustable by adjusting the amount of thread engagement of the horizontal bolts 51 in the facing plate portions 41*b*. The horizontal bolts 51 are pressed against two side surfaces of the vertical stanchion groove 21 so as to apply pressure between the side surfaces of the vertical stanchion groove 21 and the facing plate portions 41*b*. The safety frame 31 is fixed to the vertical stanchion 10 mainly in the width direction of the vertical stanchion 10 (left and right) by the horizontal bolts 51 applying pressure between the side surfaces of the vertical stanchion groove 21 and the facing plate portions 41*b*. The position of the frame main body 41 in the width direction of the vertical stanchion 10 is adjusted by adjusting the amount of thread engagement of the left and right horizontal bolts 51 such that a center position of the frame main body 41 is aligned with a center position of the guide rail 1.

The jack bolts 52 protrude upward from the horizontal plates 42. The amount of protrusion of each of the jack bolts 52 from the horizontal plates 42 is adjustable by adjusting the amount of thread engagement of the jack bolts 52 relative to the horizontal plates 42. Each of the jack bolts 52 is pressed against a lower surface of the guiding apparatus mounting bases 13 so as to apply pressure between the lower surface of the guiding apparatus mounting bases 13 and the horizontal plates 42 (FIGS. 4 through 6). The safety frame 31 is fixed to the vertical stanchion 10 mainly in the vertical direction of the vertical stanchions 10 by the respective jack bolts 52 applying pressure between the lower surfaces of the guiding apparatus mounting bases 13 and the horizontal plates 42. The locknuts 54 that fasten the jack bolts 52 to the horizontal plates 42 are screwed onto the jack bolts 52. The amount of protrusion of the jack bolts 52 from the horizontal plates 42 is fixed by fastening of the locknuts 54.

The restricting bolts 53 protrude downward from the horizontal plates 42. The amount of protrusion of each of the restricting bolts 53 from the horizontal plates 42 is adjustable by adjusting the amount of thread engagement of the restricting bolts 53 relative to the horizontal plates 42. Each of the restricting bolts 53 is configured so as to hold the back plate portion 10*a* at an upper end portion of the vertical stanchion 10 against the back surface of the rear plate portion 41*a* of the frame main body 41. The safety frame 31 is fixed to the vertical stanchion 10 mainly in a thickness direction of the vertical stanchion 10 (a depth direction of the vertical stanchion groove 21) by the restricting bolts 53 holding the back plate portion 10*a* against the frame main body 41.

A tapered portion that becomes narrower toward a tip end portion is formed on a screw-threaded portion of each of the restricting bolts 53. Screw thread is not formed on the tapered portions. The frame main body 41 is placed in close contact with the back plate portion 10*a* of the vertical stanchion 10 by the action of the tapered portions by screwing the restricting bolts 53 into the horizontal plates 42 to increase the amount of downward protrusion. The back plate portion 10*a* at the upper end portion of the vertical stanchion 10 is thereby held firmly between the frame main body 41 and each of the restricting bolts 53.

As shown particularly in FIGS. 4 and 7, the safety device main body 33 is disposed in a space between the pair of facing plate portions 41*b* (i.e., a space inside the frame main body 41). The safety device main body 33 has: a movable base (a movable body) 61 that can be moved vertically relative to the frame main body 41; a pair of wedges (a braking member) 62 that are disposed on the movable base 61 so as to be displaced vertically together with the movable base 61; a pair of guiding members 63 that are supported by the frame main body 41 so as to guide the wedges 62 in a direction of contact with and separation from the guide rail 1 by the vertical displacement of the wedges 62; and a plurality of compressed springs (elastic bodies) 64 (FIG. 4) that are disposed between the guiding members 63 and the facing plate portions 41*b*.

Each of the guiding members 63 is disposed so as to be separated from the guide rails 1 on two width direction sides of the guide rails 1. An inclined surface that is inclined relative to the guide rail 1 so as to be further away from the guide rail 1 lower down is formed on each of the guiding members 63.

The wedges 62 are mounted onto a shared movable base 61 so as to be displaceable horizontally. The wedges 62 are disposed on two sides of the guide rail 1 in the width direction of the vertical stanchion 10, and are respectively disposed between the inclined surfaces of the guiding members 63 and the guide rail 1.

The wedges 62 contact the guide rail 1 while being guided by the inclined surfaces of the guiding members 63 by being displaced upward relative to the frame main body 41 together with the movable base 61, and push open gaps between the guide rail 1 and the guiding members 63 by being displaced further upward. Each of the compressed springs 64 is compressed by the gap between the guide rail 1 and the guiding members 63 being pushed open by the wedges 62, generating an elastic force of recovery. The wedges 62 are pressed against the guide rail 1 from two sides by the elastic forces of recovery of the compressed springs 64 so as to grip the guide rail 1. When the guide rail 1 is gripped by the wedges 62, frictional force is generated between the wedges 62 and the guide rail 1, applying a braking force to the car 2. In other words, in this example, the safety device main bodies 33 are progressive safety device main bodies in which the magnitude of the braking force on the car 2 is maintained stably.

The safety mounting apparatuses 34 are mounted onto each of the upper beams 22 individually. The safety mounting apparatuses 34 have: a metal brace (a restraining member) 71 that is disposed above the lower plate portion 22*c*; a metal mounting device (a safety-supporting member) 72 that is disposed below the lower plate portion 22*c* so as to hold the lower plate portion 22*c* from opposite sides together with the metal brace 71; and a plurality of fastening bolts 73 that fasten the metal brace 71 and the metal mounting device 72. The metal mounting device 72 has: a backing plate portion 72*a* that is disposed alongside the lower plate portion 22*c*; and, a flat bearing portion 72*b* that protrudes downward from the backing plate portion 72*a*.

A plurality of penetrating apertures 74 through which the fastening bolts 73 are passed are disposed on the metal brace 71. A plurality of screw-threaded apertures 75 into which the fastening bolts 73 are screwed are disposed on the backing plate portion 72*a* of the metal mounting device 72. The metal brace 71 and the metal mounting device 72 are fastened by screwing the fastening bolts 73 that have been passed through the penetrating apertures 74 into the screw-threaded apertures 75 and fastening them. The safety mounting apparatuses 34 are mounted to the upper frame 9 by clamping the lower plate portions 22*c* of the upper beams 22 between the metal braces 71 and the metal mounting devices 72.

The actuating apparatuses 35 have: a pivoting shaft 81 that is rotatably supported horizontally by the shaft-bearing portions 72*b*; a pivoting lever 82 that is disposed on the pivoting shaft 81 so as to be pivoted together with the pivoting shaft 81; and a chain (a cord-like body) 83 that is connected to the movable base 61 so as to suspend the wedges 62 and pull the movable base 61 and the wedges 62 up by being pulled by the pivoting lever 82. Moreover, in this example, the cord-like body that suspends the wedges 62 is a chain 83, but the cord-like body may also be a wire, a rope, or a belt, for example.

A penetrating slot 84 is disposed on an end portion of the pivoting lever 82. An upper end portion of the movable base 61 is connected to a first end portion of the chain 83, and a screw-threaded rod 85 that is passed through the penetrating slot 84 is connected to a second end portion of the chain 83. A plurality of nuts 86 that prevent the screw-threaded rod 85 from dislodging from the penetrating slot 84 are screwed onto the screw-threaded rod 85. The chain 83 extends from the first end portion, to which the movable base 61 is connected, over the inclined plate 43, and then to the second end portion, to which the screw-threaded rod 85 is connected. The chain 83 is guided by the inclined plate 43 while being moved by the pivoting lever 82 being pivoted. The movable base 61 and the wedges 62 are displaced vertically by the movement of the chain 83.

The rope connecting apparatus 18 has: a rod (a rod-shaped body) 91 that is fastened by a plurality of clips (fastening devices) 92 to the first end portion and the second end portion of the speed governor rope 17; an upper portion backing plate 93 and a lower portion backing plate 94 that are respectively disposed on the rod 91 so as to be separated from each other in a longitudinal direction of the rod 91; an intermediate member 95 that is disposed between the upper portion backing plate 93 and the lower portion backing plate 94 so as to be displaceable in the longitudinal direction of the rod 91; and connecting springs (elastic bodies) 96 that are respectively interposed between the intermediate member 95 and the upper portion backing plate 93 and between the intermediate member 95 and the lower portion backing plate 94. The intermediate member 95 is configured so as to be subjected to elastic forces of recovery from the connecting springs 96 in directions of return to their original positions when displaced relative to the rod 91.

The safety linking apparatus 19 has: a first link 101 that is coupled pivotably to the intermediate member 95 by means of a pin 104; and a second link 102 that is fixed to the pivoting shaft 81 so as to be coupled pivotably to the first link 101 by means of a pin 103. The second link 102 is pivoted together with the pivoting shaft 81.

If the car 2 is displaced downward relative to the rope connecting apparatus 18, the safety linking apparatus 19 operates interdependently in response to the displacement of the car 2 relative to the rope connecting apparatus 18 such that the pivoting shaft 81 is pivoted in a direction in which the wedges 62 are pulled upward.

The car linking apparatus 20 has: a rope-coupling mounting apparatus 111 that is mounted onto the upper frame 9 by clamping the lower plate portion 22*c*; and a link 112 that is coupled between the intermediate member 95 and the rope-coupling mounting apparatus 111.

The rope-coupling mounting apparatus 111 has: a metal brace (a restraining member) 113 that is disposed above the lower plate portion 22*c*; a metal mounting device (a coupling mounting member) 114 that is disposed below the lower plate portion 22*c* so as to hold the lower plate portion 22*c* from opposite sides together with the metal brace 113; and a plurality of fastening bolts 115 that fasten the metal brace 113 and the metal mounting device 114. The metal mounting device 114 has: a backing plate portion 114*a* that is disposed alongside the lower plate portion 22*c*; and a vertical plate portion 114*b* that protrudes downward from the backing plate portion 114*a*.

A plurality of penetrating apertures 116 through which the fastening bolts 115 are passed are disposed on the metal brace 113. A plurality of screw-threaded apertures 117 into which the fastening bolts 115 are screwed are disposed on the backing plate portion 114*a* of the metal mounting device 114. The metal brace 113 and the metal mounting device 114 are fastened by screwing the fastening bolts 115 that have been passed through the penetrating apertures 116 into the screw-threaded apertures 117 and fastening them. The rope-coupling mounting apparatus 111 is mounted to the upper frame 9 by clamping the lower plate portion 22*c* of an upper beam 22 between the metal brace 113 and the metal mounting device 114.

A first end portion of the link 112 is coupled pivotably to the intermediate member 95 by means of the pin 104, and a second end portion of the link 112 is coupled pivotably to the vertical plate portion 114*b* of the metal mounting device 114 by means of a pin 118.

As shown in FIG. 3, the coupling apparatus 16 couples together the pivoting shafts 81 of each of the safety devices 15. The coupling apparatus 16 has: a pair of (first and second) pivoting arms 121 that are fixed individually to each of the pivoting shafts 81; and a coupling member 122 that couples together each of the pivoting arms 121.

A first end portion of the coupling member 122 is coupled pivotably to the first pivoting arm 121 by means of a pin, and a second end portion of the coupling member 122 is coupled pivotably to the second pivoting arm 121 by means of a pin. The pin that is disposed on the first end portion of the coupling member 122 and a pin that is disposed on the second end portion of the coupling member 122 are positioned at mutually opposite ends of a plane that contains the shaft axis of each of the pivoting shafts 81. Thus, when the safety linking apparatus 19 is operated by the displacement of the car 2 relative to the rope connecting apparatus 18, the respective pivoting shafts 81 are pivoted interdependently by the coupling apparatus 16 so as to be oriented in opposite directions to each other such that each of the safety devices 15 is operated in synchrony.

The coupling member 122 has: a cylindrical joint member 123 that has an inner surface that is a screw-threaded portion; and a pair of coupling rods 124 that are coupled to each of the pivoting arms 121 individually, and that are screwed into two end portions of the joint members 123. A longitudinal dimension of the coupling member 122 is adjustable by adjusting the amount of thread engagement of each of the coupling rods 124 into the joint member 123.

When a hydraulic direct-coupled plunger-type elevator in which safety devices are not mounted onto a car 2 is remodeled into a suspension elevator such as that described above, in which safety devices 15 are mounted onto the car 2, a hydraulic jack that is directly coupled to the car 2 is removed, and a hoisting machine is installed at a predetermined position inside the hoistway, and the car 2 is suspended using suspending bodies 3 that are wound onto the driving sheave of the hoisting machine. A speed governor and a tensioning sheave are installed inside the hoistway, and a speed governor rope 17 is wound continuously around the speed governor sheave and the tensioning sheave, and then the first end portion and the second end portion of the speed governor rope 17 are connected using the rope connecting apparatus 18. In addition, the safety devices 15 are mounted onto the car 2, and then the safety devices 15 and the rope connecting apparatus 18 are coupled using the safety linking apparatus 19, and the car frame 5 and the rope connecting apparatus 18 are coupled using the car linking apparatus 20.

Next, a method for mounting the safety devices 15 onto the car 2 will be explained. First, safety units are produced in advance by mounting safety device main bodies 33 inside frame main bodies 41. At this point, the horizontal bolts 51, the jack bolts 52, and the restricting bolts 53 are respectively predisposed on the safety frames 31 in a loosened state. The first end portions of the chains 83 are also connected to the upper end portions of the movable bases 61 (a unit preparing step).

Next, with the guiding apparatus mounting bases 13 removed from the car frame 5, the frame main bodies 41 are inserted into the vertical stanchion grooves 21, and the horizontal plates 42 are hung on the upper end portions of the vertical stanchions 10. The safety units are thereby held on the upper portions of the vertical stanchions 10 such that the frame main bodies 41 and the safety device main bodies 33 are disposed inside the vertical stanchion grooves 21 (a unit mounting step).

Next, the back surfaces of the frame main bodies 41 are placed in close contact with the back plate portions 10*a* of the vertical stanchions 10 by the action of the tapered portions of the restricting bolts 53 by tightening the restricting bolts 53 with the back plate portions 10*a* held between the frame main bodies 41 and the restricting bolts 53 (a restricting bolt tightening step).

Next, each of the horizontal bolts 51 is turned (manipulated) to press the horizontal bolts 51 against the side surfaces of the vertical stanchion grooves 21 to apply pressure to each of the horizontal bolts 51 between the side surfaces of the vertical stanchion grooves 21 and the facing plate portions 41*b*. Here, the positions of the safety frames 31 are adjusted in the width directions of the vertical stanchions 10 while adjusting the amount of thread engagement of the horizontal bolts 51 to align center positions of the frame main bodies 41 and the safety device main bodies 33 with the center positions of the guide rails 1 (a width direction fixing step).

Next, the backing plate portions 72*a* of the metal mounting devices 72 are placed in contact with the lower surfaces of the lower plate portions 22*c*, and the backing plate portions 72*a* and the metal braces 71 are fastened using the plurality of fastening bolts 73 such that the metal braces 71 are placed in contact with the upper surfaces of the lower plate portions 22*c*. The pivoting shafts 81 on which the pivoting levers 82, the second links 102, and the pivoting arms 121 are fixed at a predetermined angle are mounted onto the metal mounting devices 72 pivotably in advance. The safety mounting apparatuses 34 are thereby mounted onto the lower plate portions 22*c* such that the pivoting shafts 81 are supported pivotably on the safety mounting apparatuses 34 with the pivoting levers 82, the second links 102, and the pivoting arms 121 fixed thereto (a safety mounting apparatus mounting step).

Next, the screw-threaded rods 85 that are connected to the second end portions of the chains 83 are inserted into the penetrating slots 84 of the pivoting levers 82, and the plurality of nuts 86 are screwed onto the screw-threaded rods 85 so as to prevent the screw-threaded rods 85 from dislodging from the pivoting levers 82. The chains 83 are thereby connected to the pivoting levers 82 (a chain coupling step).

Next, the guiding apparatus mounting bases 13 are disposed above the safety frames 31 that are mounted onto the upper end portions of the vertical stanchions 10, and the guiding apparatus mounting bases 13 are fixed to the upper surfaces of each of the upper beams 22 by the plurality of bolts 23. The guiding apparatuses 12 and the oilers 14 are mounted onto the guiding apparatus mounting bases 13 in advance (a mounting base fixing step).

Next, each of the jack bolts 52 is turned (manipulated) to press the jack bolts 52 against the lower surfaces of the guiding apparatus mounting bases 13 to apply pressure to each of the jack bolts 52 between the guiding apparatus mounting bases 13 and the horizontal plates 42. At this point, the respective locknuts 54 are tightened onto the horizontal plates 42 so as to prevent each of the jack bolts 52 from loosening (a vertical fixing step). The safety devices 15 are thereby mounted onto the car 2.

Next, as described above, a speed governor and a tensioning sheave are installed inside the hoistway, and a first end portion and a second end portion of a speed governor rope that is wound continuously around the speed governor sheave and the tensioning sheave are connected using the rope connecting apparatus 18.

Next, the backing plate portion 114*a* of the metal mounting device 114 is placed in contact with the lower surface of the lower plate portion 22*c*, and the backing plate portion 114*a* and the metal brace 113 are fastened using the plurality of fastening bolts 115 such that the metal brace 113 is placed in contact with the upper surface of the lower plate portion 22*c*. The lower plate portion 22*c* is thereby held between the metal brace 113 and the metal mounting device 114, mounting the rope-coupling mounting apparatus 111 onto the lower plate portion 22*c* (a rope-coupling mounting apparatus mounting step).

Next, the first link 101 is coupled between the intermediate member 95 of the rope connecting apparatus 18 and the second link 102, and the link 112 is coupled between the intermediate member 95 of the rope connecting apparatus 18 and the vertical plate portion 114*b* of the metal mounting device 114.

The pair of safety devices 15 are mounted onto the car 2, and then the coupling member 122 is coupled between the pivoting arms 121 of the pair of (first and second) pivoting shafts 81 that are mounted left and right (a pivoting arm coupling step). In addition, equipment relating to the safety devices 15 is installed by wiring between switches such as an overspeed switch of the speed governor, etc., and the controlling board, and performing adjustment of equipment such as the speed governor, for example.

Next, operation will be explained. When the car 2 is moved, the speed governor rope 17 is moved together with the car 2, thereby moving the speed governor sheave in response to the movement of the car 2. If the descent speed of the car 2 rises for any reason and reaches a set overspeed that is preset, an overspeed switch that is disposed on the speed governor is activated. Thus, power supply to the hoisting machine that moves the car 2 is stopped, activating the hoisting machine braking apparatus.

If the descent speed of the car 2 rises further after the power supply to the hoisting machine is stopped and reaches a safety overspeed that is higher than the set overspeed, the speed governor is activated and the speed governor rope 17 is gripped by the speed governor. Thus, movement of the speed governor rope 17 stops, and the car 2 is displaced downward relative to the rope connecting apparatus 18.

If the car 2 is displaced downward relative to the rope connecting apparatus 18, the first pivoting shaft 81 is pivoted by means of the safety linking apparatus 19. Here, the second pivoting shaft 81 is also pivoted interdependently with the first pivoting shaft 81 by the coupling apparatus 16. The wedges 62 of each of the safety devices 15 are thereby pulled upward by means of the pivoting levers 82 and the chains 83 such that the respective guide rails 1 are gripped by the pairs of wedges 62. Thus, a braking force is generated on the car 2, making the car 2 perform an emergency stop.

In an elevator safety device 15 of this kind, because the safety frames 31 are fixed onto the vertical stanchions 10 by the respective horizontal bolts 51 applying pressure between the side surfaces of the vertical stanchion grooves 21 and the frame main bodies 41, and the respective jack bolts 52 applying pressure between the guiding apparatus mounting bases 13 and the horizontal plates 42, and the safety device main bodies 33 are disposed on the safety frames 31, the safety frames 31 can be fixed to the car frame 5 and the safety device main bodies 33 can be mounted to the car frame 5 without machining the car frame 5. Thus, during mounting of the safety device main bodies 33 onto the car frame 5, time spent on machining the car frame 5 at a factory, etc., can be eliminated, enabling the safety devices 15 to be easily mounted onto the car 2. Consequently, the installation work period for the safety devices 15 can be shortened, enabling shortening of down time during which the elevator cannot be used to be achieved. Because the frame main bodies 41 on which the safety device main bodies 33 are disposed are inserted inside the vertical stanchion grooves 2, the safety device main bodies 33 can be prevented from protruding significantly vertically from the car 2. Thus, the safety devices 15 can be mounted to the car 2 even if there is not sufficient room in the pit of the hoistway, for example.

Because the restricting bolts 53 that protrude downward from the horizontal plates 42 to clamp the back surfaces of the frame main bodies 41 against the upper end portions of the vertical stanchions 10 are disposed on the safety frames 31, the safety frames 31 can be fixed reliably to the vertical stanchions 10.

Because the safety mounting apparatuses 34 are mounted onto the car frame 5 by clamping the upper frame 9, the safety mounting apparatuses 34 can be easily mounted to the car frame 5 without machining the car frame 5.

Because the actuating apparatuses 35 that displace the wedges 62 to activate the safety device main bodies 33 have: pivoting shafts 81; pivoting levers 82 that are pivoted together with the pivoting shafts 81; and chains 83 that pull up the wedges 62 by being pulled by the pivoting levers 82 while suspending the wedges 62, the safety device main bodies 33 can be activated more reliably using a simple configuration.

Because the pairs of wedges 62 are disposed on two sides of the guide rails 1, and the raised wedges 62 are respectively guided in a direction of contact with the guide rails 1 by the pairs of guiding members 63, the safety device main bodies 33 that are disposed on the safety frames 31 can be made into progressive safety device main bodies.

In a method for mounting a safety device 15 of this kind, because the safety units in which the safety device main bodies 33 that are mounted into the safety frames 31 are inserted into the vertical stanchion grooves 21, and pressure is applied to the horizontal bolts 51 between the side surfaces of the vertical stanchion grooves 21 and the frame main bodies 41 of the safety frames 31 by manipulating the horizontal bolts 51 and pressure is applied to the jack bolts 52 between the guiding apparatus mounting bases 13 and the horizontal plates 42 of the safety frames 31 by manipulating the jack bolts 52, a need to machine the car frame 5 is eliminated, enabling the safety device main bodies 33 to be mounted to the car frame 5 easily. The safety device main bodies 33 can also be prevented from protruding significantly vertically from the car 2.

Embodiment 2

In Embodiment 1, progressive safety device main bodies 33 in which the magnitude of the braking force on the car 2 is maintained stably are disposed on the safety frames 31, but instantaneous safety device main bodies that generate a braking force against the car 2 rapidly to stop the car 2 almost instantaneously may also be disposed on the safety frames 31.

Figure 9:
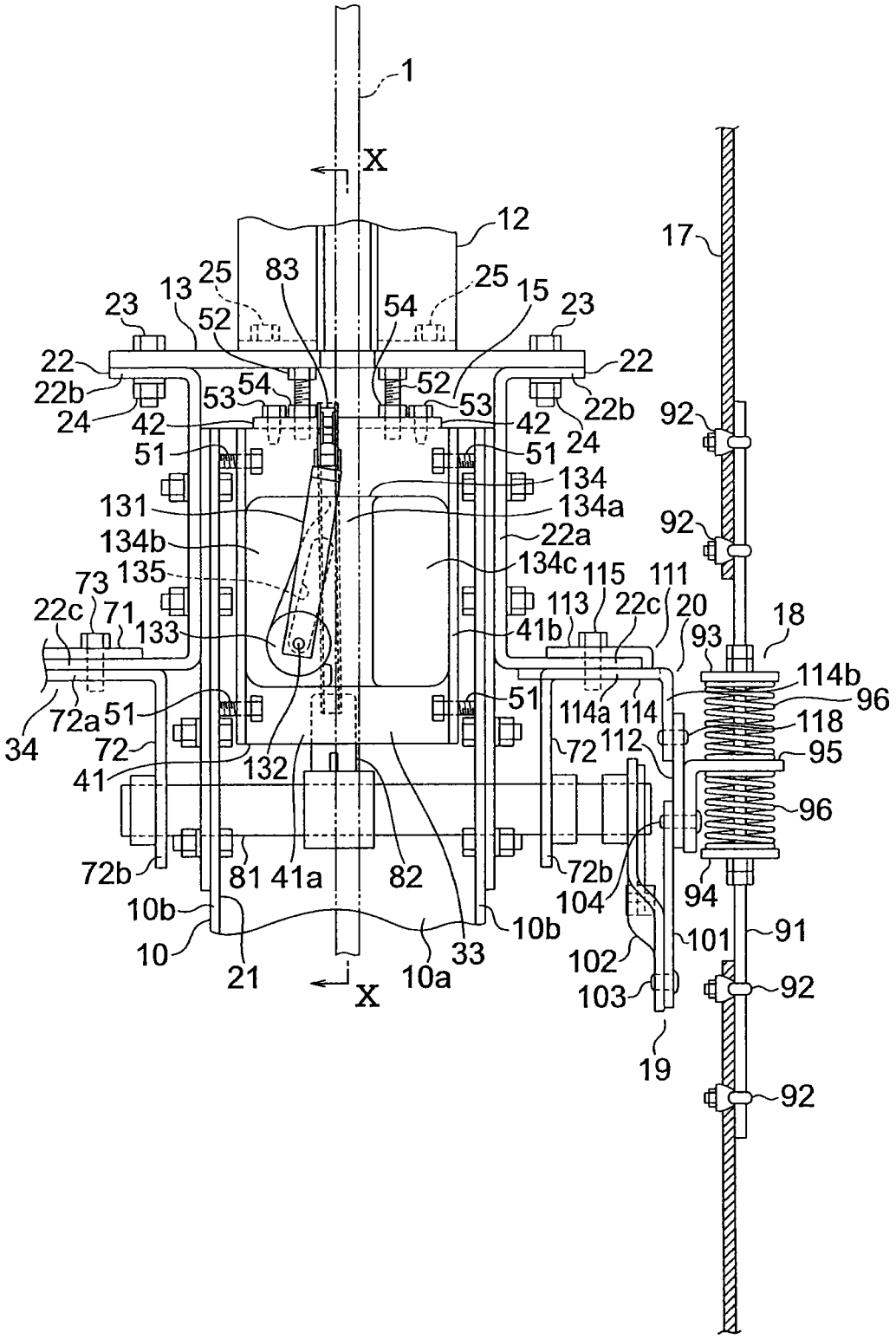
FIG. 9 is a side elevation that shows an upper portion of a car frame according to Embodiment 2 of the present invention.
Figure 10:
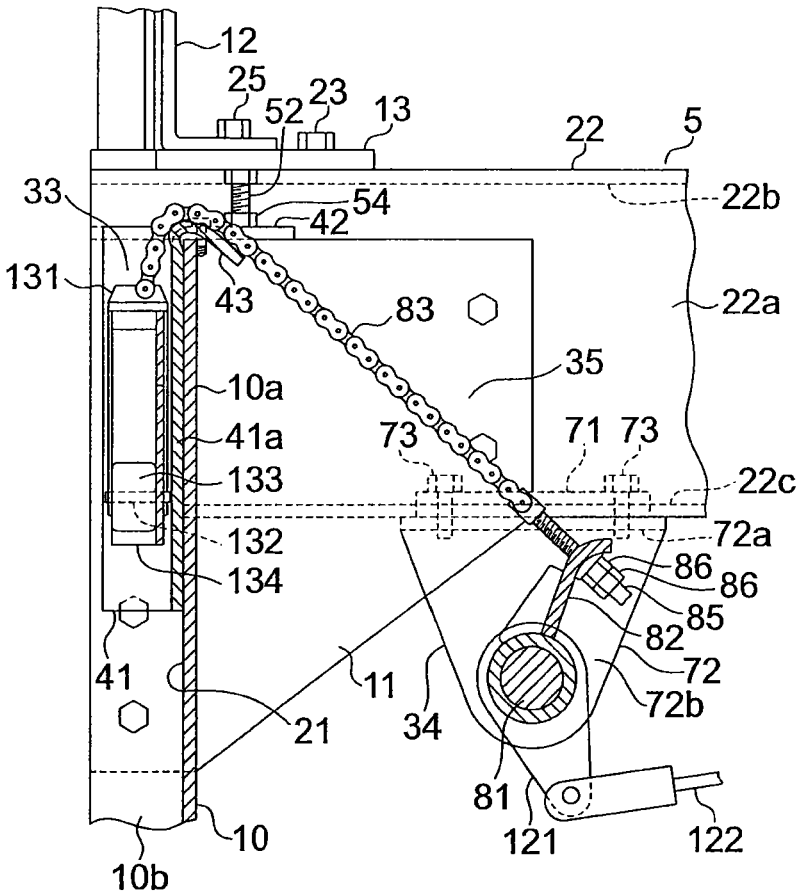
FIG. 10 is a cross section that is taken along Line X-X in FIG. 9.
Figure 11:
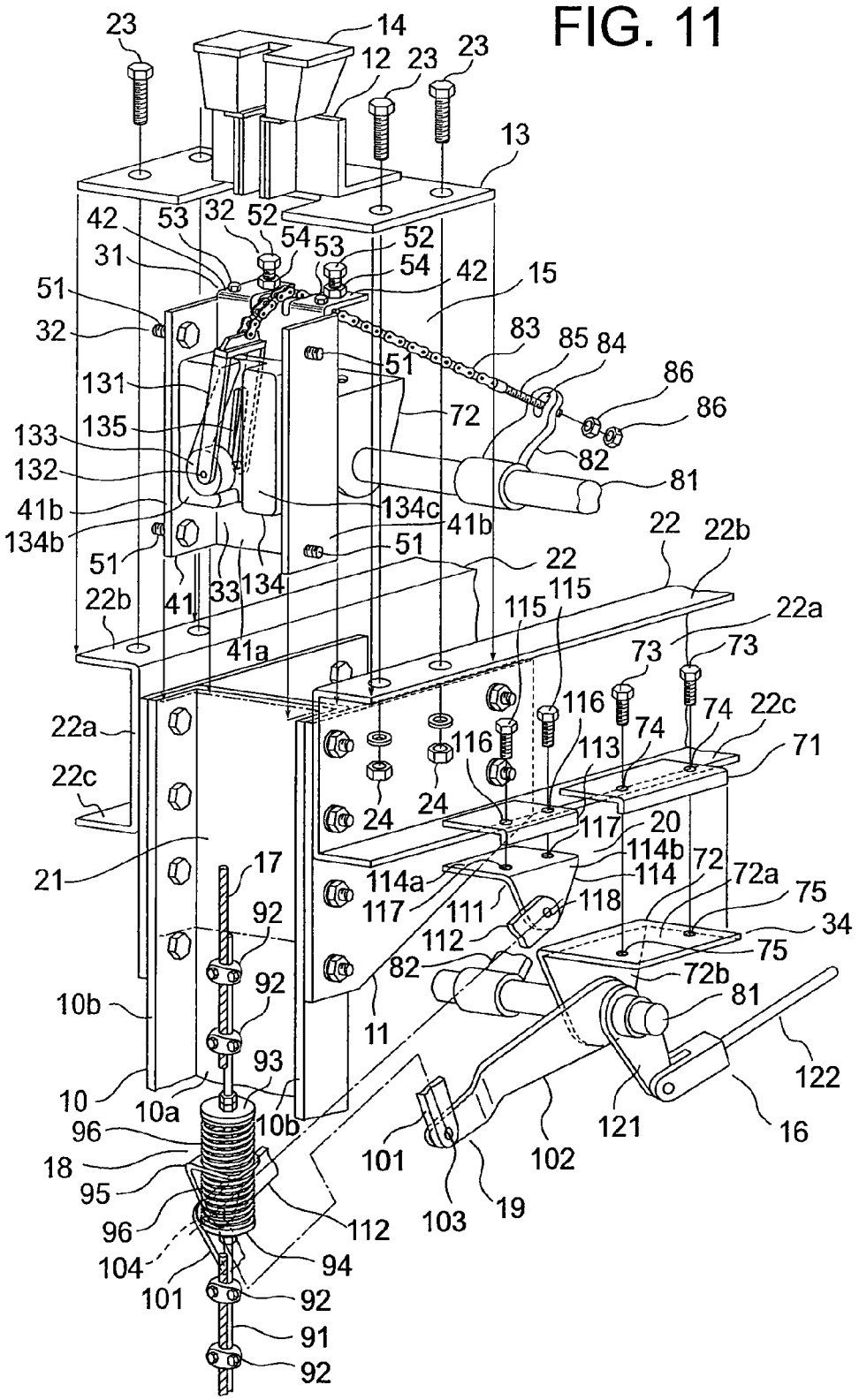
FIG. 11 is an exploded perspective that shows the upper portion of the car frame from FIG. 9.
Figure 12:
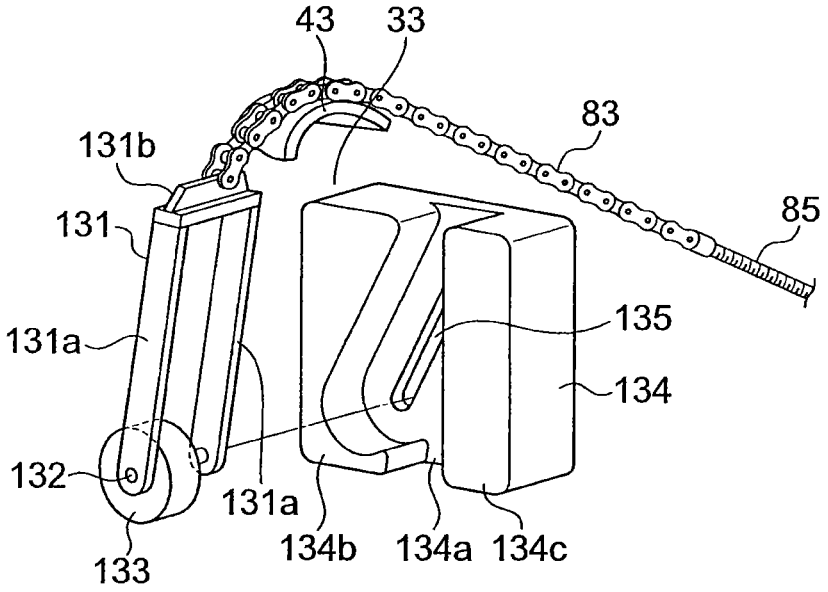
FIG. 12 is an exploded perspective that shows a safety device main body from FIG. 11.

Specifically, FIG. 9 is a side elevation that shows an upper portion of a car frame 5 according to Embodiment 2 of the present invention. FIG. 10 is a cross section that is taken along Line X-X in FIG. 9. FIG. 11 is an exploded perspective that shows the upper portion of the car frame 5 from FIG. 9, and FIG. 12 is an exploded perspective that shows a safety device main body 33 from FIG. 11. In Embodiment 2, the rest of the configuration is similar or identical to that of Embodiment 1 except that the configuration of the safety device main body 33 is different from that of Embodiment 1.

The safety device main body 33 has: a metal portal fitting (a movable body) 131 that can be moved vertically relative to the frame main body 41; a roller (a braking member) 133 that is disposed on the metal portal fitting 131 by means of a roller shaft (a rotating shaft) 132 so as to be displaced vertically together with the metal portal fitting 131; and a gripper 134 that is fixed to the frame main body 41 so as to guide the roller 133 in a direction of contact with and separation from the guide rail 1 by the vertical displacement of the roller 133.

The metal portal fitting 131 has: a pair of mounting frames 131*a* that each have a predetermined length and that face each other; and a coupling frame 131*b* that links together first end portions of each of the mounting frames 131*a*. The roller shaft 132 is supported between second end portions of each of the mounting frames 131*a*. The roller 133 is disposed between the second end portions of each of the mounting frames 131*a* so as to be rotatable around the roller shaft 132.

The metal gripper 134 has: a base portion 134*a* that faces the rear plate portion 41*a* so as to leave a gap; and a guiding portion 134*b* and a bearing portion 134*c* that each rise toward the guide rail 1 from the base portion 134*a* so as to be disposed on two sides in a width direction of the guide rails 1.

The guide rail 1 is inserted into a space that is formed between the guiding portion 134*b* and the bearing portion 134*c*. A surface of the guiding portion 134*b* near the bearing portion 134*c* is an inclined surface that is inclined relative to the guide rail 1 in a direction that is further away from the guide rail 1 lower down. A surface of the bearing portion 134*c* near the guiding portion 134*b* is a vertical surface that is parallel to the guide rail 1.

A penetrating slot (a roller shaft escape slot) 135 that is parallel to the inclined surface of the guiding portion 134*b* is disposed on the base portion 134*a*. The roller 133 is disposed between the inclined surface of the guiding portion 134*b* and a side surface of the guide rail 1. The roller shaft 132 is passed through the penetrating slot 135. Each of the mounting frames 131*a* are respectively disposed on two sides in a thickness direction of the metal gripper 134 so as to support the roller shaft 132 that is passed through the penetrating slot 135.

A first end portion of the chain 83 is connected to the coupling frame 131*b*. The position of the roller 133 is a position that is offset toward the guiding portion 134*b* from the central axis of the guide rail 1 when the safety device main body 33 is viewed from a side near the guide rail 1. The chain 83 is thereby also inclined toward the guiding portion 134*b*. The roller 133 is displaced upward relative to the safety frame 31 by the metal portal fitting 131 being pulled up by the chain 83.

The roller 133 contacts the guide rail 1 while being guided by the inclined surface of the guiding member 134*b* and the penetrating slot 135 by being displaced upward relative to the frame main body 41, and pushes open the gap between the inclined surface of the guiding member 134*b* and the guide rail 1 by being displaced further upward. The metal gripper 134 is thereby displaced in the width direction relative to the guide rail 1 such that the vertical surface of the bearing portion 134*c* contacts the guide rail 1, and the roller 133 wedges between the inclined surface of the guiding portion 134*b* and the guide rail 1. The guide rail 1 is thereby gripped between the vertical surface of the bearing portion 134*c* and the roller 133. When the guide rail 1 is gripped between the vertical surface of the bearing portion 134*c* and the roller 133, frictional force is generated between the vertical surface of the bearing portion 134*c* and the guide rail 1, rapidly applying a braking force to the car 2. Using this construction, the safety device main bodies 33 are instantaneous safety device main bodies in which the braking force on the car 2 is generated rapidly.

Thus, even if instantaneous safety device main bodies that grip the guide rails 1 between the rollers 133 and the metal grippers 134 are used as the safety device main bodies 33 that are disposed on the safety frames 31, similar effects to those in Embodiment 1 can be achieved such as preventing significant vertical protrusion from the car 2 and enabling easy mounting onto the car 2.

Moreover, in each of the above embodiments, restricting bolts 53 are disposed on the horizontal plates 42, but the restricting bolts 53 may also be omitted provided that a fixed state of the safety frames 31 on the vertical stanchions 10 is ensured by the respective horizontal bolts 51 and the respective jack bolts 52.

In each of the above embodiments, the safety devices 15 are mounted onto the car 2 during elevator remodeling work, but the safety devices 15 may also be mounted onto the car 2 in a newly installed elevator.

The invention claimed is:

1. An elevator safety device that is mounted onto a car that comprises a cage and a car frame that surrounds the cage, the car being moved along a guide rail and the elevator safety device applying a braking force to the car, the elevator safety device comprising:

a safety supporting body that includes:

a supporting body main body that is disposed inside a vertical stanchion groove that is disposed vertically on a vertical stanchion of the car frame; and an engaging portion that protrudes outward from the supporting body main body, and that is hooked onto an upper end portion of the vertical stanchion;

a supporting body fixing apparatus disposed on the safety supporting body so as to fix the safety supporting body to the vertical stanchion, the supporting body fixing apparatus includes:

a first fixing bolt that applies pressure between a side surface of the vertical stanchion groove and the supporting body main body; and a second fixing bolt that applies pressure between the engaging portion and a guiding apparatus mounting base that is fixed to the car frame above the safety supporting body;

a safety device main body that includes a braking member that is displaceable relative to the safety supporting body, and that is disposed on the safety supporting body so as to apply the braking force to the car by placing the braking member in contact with the guide rail;

a safety mounting apparatus that is mounted onto the car frame; and an actuating apparatus that is supported by the safety mounting apparatus, and that displaces the braking member to activate the safety device main body.

2. An elevator safety device according to claim 1, wherein the supporting body fixing apparatus further comprises a restricting bolt that protrudes downward from the engaging portion to clamp the upper end portion of the vertical stanchion against a back surface of the supporting body main body.

3. An elevator safety device according to claim 1, wherein the safety mounting apparatus is mounted onto the car frame by clamping the car frame.

4. An elevator safety device according to claim 1, wherein:

the actuating apparatus comprises:

a pivoting shaft that is disposed horizontally so as to be pivotable, a pivoting lever that is pivoted together with the pivoting shaft; and a cord-like body that pulls the braking member up by being pulled by the pivoting lever while suspending the braking member; and a supporting guiding portion that guides the cord-like body is disposed on an upper end portion of the supporting body main body.

5. An elevator safety device according to claim 1, wherein:

the braking member is a pair of wedges that are disposed on two sides of the guide rail; and the safety device main body comprises a pair of guiding members that respectively guide each of the pair of wedges in a direction of contact with the guide rail due to pulling up of each of the pair of wedges.

6. An elevator safety device according claim 1, wherein:

the braking member is a roller; and the safety device main body comprises a metal gripper that guides the roller in a direction of contact with the guide rail and grips the guide rail against the roller due to pulling up of the roller.

7. An elevator safety device mounting method for mounting the elevator safety device according to claim 1 onto the car, the elevator safety device mounting method comprising:

a unit producing step in which a safety unit is produced by mounting the safety device main body onto the safety supporting body;

a unit mounting step in which the supporting body main body is inserted into the vertical stanchion groove and the engaging portion is hooked onto the upper end portion of the vertical stanchion in a state in which the guiding apparatus mounting base is removed from the car frame after the unit producing step;

a width direction fixing step in which the first fixing bolt that is disposed on the supporting body main body is manipulated to apply pressure to the first fixing bolt between the side surface of the vertical stanchion groove and the supporting body main body;

a mounting base fixing step in which the guiding apparatus mounting base is disposed above the safety supporting body, and the guiding apparatus mounting base is fixed to the car frame; and a vertical fixing step in which the second fixing bolt that is disposed on the engaging portion is manipulated to apply pressure to the second fixing bolt between the guiding apparatus mounting base and the engaging portion.

* * * * *